US009737978B2

(12) United States Patent
Golden et al.

(10) Patent No.: US 9,737,978 B2
(45) Date of Patent: Aug. 22, 2017

(54) IMPACT TOOLS WITH TORQUE-LIMITED SWINGING WEIGHT IMPACT MECHANISMS

(71) Applicant: Ingersoll-Rand Company, Davidson, NC (US)

(72) Inventors: Hunter Ian Golden, Apex, NC (US); Timothy Richard Cooper, Titusville, NJ (US); Evan Dalton Gerber, Bethlehem, PA (US); Nicholas J. Able, Huntersville, NC (US)

(73) Assignee: Ingersoll-Rand Company, Davidson, NC (US)

( * ) Notice: Subject to any disclaimer, the term of this patent is extended or adjusted under 35 U.S.C. 154(b) by 672 days.

(21) Appl. No.: 14/181,205

(22) Filed: Feb. 14, 2014

(65) Prior Publication Data

US 2015/0231769 A1 Aug. 20, 2015

(51) Int. Cl.
*B25B 21/02* (2006.01)

(52) U.S. Cl.
CPC ..... *B25B 21/026* (2013.01)

(58) Field of Classification Search
CPC ..... B25B 21/026; B25B 21/02
USPC ..... 173/93, 93.5, 93.6
See application file for complete search history.

(56) References Cited

U.S. PATENT DOCUMENTS 2,285,638 A 6/1942 Amtsberg
2,414,066 A 1/1947 Scott
2,580,631 A 1/1952 Whiteledge
2,802,556 A 8/1957 Schmid
3,072,232 A 1/1963 Martin et al.
3,129,796 A * 4/1964 Karden ..... B25B 21/02 173/169

(Continued)

FOREIGN PATENT DOCUMENTS

CN 1876330 A 12/2006
DE 29713973 U1 10/1997

(Continued)

OTHER PUBLICATIONS

Chinese Office Action and English Translation for Chinese Patent Application No. 201310681033.2, dated May 7, 2015.

(Continued)

*Primary Examiner* — Hemant M Desai
*Assistant Examiner* — Valentin Neacsu
(74) *Attorney, Agent, or Firm* — Barnes & Thornburg LLP

(57) ABSTRACT

Illustrative embodiments impact tools with torque-limited swinging weight impact mechanisms are disclosed. In at least one illustrative embodiment, a swinging weight impact mechanism may comprise a hammer configured to rotate about a first axis and pivot about a second axis different from the first axis, the hammer having a void formed therein, and an asymmetric anvil disposed partially within the void, the asymmetric anvil being configured to rotate about a third axis when impacted by the hammer. The asymmetric anvil may comprise a cylindrical body and a lug extending outward from the cylindrical body. The lug may include a first impact face extending along a first plane that intersects the third axis and a second impact face extending along a second plane that does not intersect the third axis, where the second plane intersects the first plane along a line that passes through the cylindrical body of the asymmetric anvil.

20 Claims, 7 Drawing Sheets

(56) References Cited

U.S. PATENT DOCUMENTS

| | | | |
|---|---|---|---|
| 3,321,043 | A | 5/1967 | Vaughn |
| 3,533,479 | A | 10/1970 | Albertson |
| 3,552,499 | A | 1/1971 | Maurer |
| 3,557,884 | A | 1/1971 | Allen |
| 3,561,543 | A | 2/1971 | Ulbing |
| 3,661,217 | A | 5/1972 | Maurer |
| 3,666,023 | A | 5/1972 | Sakamoto |
| 3,703,933 | A | 11/1972 | Schoeps |
| 4,016,938 | A | 4/1977 | Rice |
| 4,023,627 | A | 5/1977 | Clapp et al. |
| 4,026,369 | A | 5/1977 | Vliet |
| 4,084,646 | A | 4/1978 | Kurt et al. |
| 4,142,447 | A | 3/1979 | Krasnoff et al. |
| 4,243,109 | A | 1/1981 | Anderson |
| 4,243,111 | A | 1/1981 | Willoughby et al. |
| 4,287,956 | A | 9/1981 | Maurer |
| 4,321,973 | A | 3/1982 | Maurer |
| 4,397,220 | A | 8/1983 | Russo et al. |
| 4,440,237 | A | 4/1984 | Casperovich |
| 4,487,272 | A | 12/1984 | Bleicher et al. |
| 4,919,022 | A | 4/1990 | Ono et al. |
| 4,977,966 | A | 12/1990 | Farber et al. |
| 5,022,309 | A | 6/1991 | Campbell |
| 5,031,505 | A | 7/1991 | Campbell |
| RE33,711 | E | 10/1991 | Ono et al. |
| 5,123,504 | A | 6/1992 | Oetting et al. |
| 5,167,309 | A | 12/1992 | Albert et al. |
| 5,172,774 | A | 12/1992 | Melrose |
| 5,197,711 | A | 3/1993 | Geiger et al. |
| 5,213,167 | A | 5/1993 | Best et al. |
| 5,284,318 | A | 2/1994 | Geiger et al. |
| 5,293,747 | A | 3/1994 | Geiger |
| 5,293,959 | A | 3/1994 | Kimberlin |
| 5,305,835 | A | 4/1994 | Campbell |
| 5,346,024 | A | 9/1994 | Geiger et al. |
| 5,350,025 | A | 9/1994 | Campbell et al. |
| 5,377,769 | A | 1/1995 | Hasuo et al. |
| 5,400,860 | A | 3/1995 | Best et al. |
| 5,573,073 | A | 11/1996 | Schofield et al. |
| 5,592,396 | A | 1/1997 | Tambini et al. |
| 5,595,251 | A | 1/1997 | Cook |
| 5,636,698 | A | 6/1997 | Estep et al. |
| 5,680,808 | A | 10/1997 | Day et al. |
| 5,689,434 | A | 11/1997 | Tambini et al. |
| 5,738,177 | A | 4/1998 | Schell et al. |
| 5,845,718 | A | 12/1998 | Cooper et al. |
| 5,848,655 | A | 12/1998 | Cooper et al. |
| 5,906,244 | A | 5/1999 | Thompson et al. |
| 6,024,180 | A | 2/2000 | Lin |
| 6,070,674 | A | 6/2000 | Williamson et al. |
| 6,093,128 | A | 7/2000 | Seith |
| 6,165,096 | A | 12/2000 | Seith |
| 6,491,111 | B1 | 12/2002 | Livingston et al. |
| 6,889,778 | B2 | 5/2005 | Colangelo, III |
| 8,020,630 | B2 * | 9/2011 | Amend ..... B25B 21/02 173/1 |
| 8,042,621 | B2 | 10/2011 | Barezzani et al. |
| 2003/0009262 | A1 | 1/2003 | Colangelo et al. |
| 2004/0149469 | A1 * | 8/2004 | Colangelo, III ..... B25B 21/026 173/93.5 |
| 2009/0038816 | A1 | 2/2009 | Johnson |
| 2009/0056966 | A1 | 3/2009 | Grand et al. |
| 2010/0025063 | A1 | 2/2010 | Kuhnapfel et al. |

FOREIGN PATENT DOCUMENTS

| | | | |
|---|---|---|---|
| DE | 20118029 | U1 | 1/2002 |
| EP | 2263833 | B1 | 12/2010 |
| GB | 763116 | | 12/1956 |
| GB | 2055653 | A | 3/1981 |
| GB | 2059317 | A | 4/1981 |
| GB | 2380962 | A | 4/2003 |
| JP | 2000052268 | A | 2/2000 |
| JP | 2002046079 | A | 2/2002 |
| JP | 2003071736 | A | 3/2003 |
| TW | 200817141 | A | 4/2008 |
| WO | 9917909 | | 4/1999 |

OTHER PUBLICATIONS

Ingersoll Rand, Torque Limited Air Impact Wrench, 2130XP-TL, Product Information, Sep. 2010, 8 pages.

* cited by examiner

IMPACT TOOLS WITH TORQUE-LIMITED SWINGING WEIGHT IMPACT MECHANISMS

TECHNICAL FIELD

The present disclosure relates, generally, to impact tools and, more particularly, to impact tools having torque-limited swinging weight impact mechanisms.

BACKGROUND

An impact tool (e.g., an impact wrench) may be used to install and remove fasteners. An impact tool generally includes a motor coupled to an impact mechanism that converts torque provided by the motor into a series of powerful rotary blows directed from one or more hammers to an anvil that is integrally formed with (or otherwise coupled to) an output drive of the impact tool. In many impact tools, the impact mechanism is typically configured to deliver the same amount of torque to the output drive when installing the fastener as when removing the fastener.

SUMMARY

According to one aspect, an impact tool may comprise a swinging weight impact mechanism that comprises a hammer configured to rotate about a first axis and to pivot about a second axis different from the first axis, the hammer having a void formed therein, and an asymmetric anvil disposed partially within the void formed in the hammer, the asymmetric anvil being configured to rotate about a third axis when impacted by the hammer. The asymmetric anvil may comprise a cylindrical body and a lug extending outward from the cylindrical body, where the lug includes (i) a first impact face that extends along a first plane that intersects the third axis and (ii) a second impact face that extends along a second plane that does not intersect the third axis. The second plane may intersect the first plane along a line that passes through the cylindrical body of the asymmetric anvil. In some embodiments, the third axis may be coincident with the first axis.

In some embodiments, the asymmetric anvil is not symmetric about any line that is perpendicular to the third axis and passes through the lug. The lug may extend outward from a first half of the cylindrical body of the asymmetric anvil, and the line at which the first and second planes intersect may pass through a second half of the cylindrical body of the asymmetric anvil that is opposite the first half.

In some embodiments, the first impact face of the lug of the asymmetric anvil may be configured to be impacted by the hammer in response to rotation of the hammer about the first axis in a first direction, and the second impact face of the lug of the asymmetric anvil may be configured to be impacted by the hammer in response to rotation of the hammer about the first axis in a second direction opposite the first direction. The asymmetric anvil may further include an output drive configured to mate with one of a plurality of interchangeable sockets. The first direction may be a counter-clockwise direction, and the second direction may be a clockwise direction.

In some embodiments, the swinging weight impact mechanism may further comprise a hammer frame supporting the hammer for rotation therewith about the first axis, where the hammer is pivotably coupled to the hammer frame via a pivot pin disposed along the second axis. The impact tool may further comprise a motor coupled to the hammer frame and configured to drive rotation of the hammer frame about the first axis. In other embodiments, the impact tool may further comprise a motor coupled to a camming plate of the swinging weight impact mechanism, where the motor is configured to drive rotation of the camming plate about the first axis such that the camming plate drives rotation of the hammer about the first axis.

According to another aspect, an impact tool may comprise a swinging weight impact mechanism that comprises a hammer frame supporting a hammer for rotation therewith about a first axis, the hammer being pivotably coupled to the hammer frame such that the hammer is configured to pivot about a second axis different from the first axis, a camming plate configured to rotate about the first axis to drive rotation of the hammer about the first axis, and an asymmetric anvil configured to rotate about the first axis when impacted by the hammer. The asymmetric anvil may comprise a cylindrical body and a lug extending outward from the cylindrical body. The lug may include (i) a first impact face extending outward from the cylindrical body at a first angle relative to the cylindrical body and (ii) a second impact face extending outward from the cylindrical body at a second angle relative to the cylindrical body, where the second angle is different from the first angle.

In some embodiments, the cylindrical body may have a first radius relative to the first axis, and the lug may have a second radius relative to the first axis, where the second radius is greater than the first radius. The lug may include an outer surface extending between the first and second impact faces. An entirety of the outer surface may have the second radius.

In some embodiments, the first impact face may extend along a first plane that is orthogonal to the cylindrical body, and the second impact face may extend along a second plane that is not orthogonal to the cylindrical body. In some embodiments, the asymmetric anvil is not symmetric about any line that is perpendicular to the first axis and passes through the lug.

According to yet another aspect, an impact tool may comprise a swinging weight impact mechanism that comprises a hammer configured to rotate about a first axis and to pivot about a second axis different from the first axis, the hammer including a first impact face and a second impact face, a camming plate configured to rotate about the first axis to drive rotation of the hammer about the first axis, and an anvil configured to rotate about the first axis when impacted by the hammer, the anvil including a cylindrical body and a lug extending outward from the cylindrical body, the lug including a first impact face and a second impact face. The first impact faces of the hammer and the anvil may be arranged such that a reactionary force resulting from an impact between the first impact faces includes a first force component in a radially outward direction relative to the first axis. The second impact faces of the hammer and the anvil may be arranged such that a reactionary force resulting from an impact between the second impact faces does not include a second force component in a radially outward direction relative to the first axis that is equal in magnitude to or greater in magnitude than the first force component.

In some embodiments, the hammer may be formed to include a void and first and second jaws extending into the void, where the first jaw includes the first impact face of the hammer and the second jaw includes the second impact face of the hammer. The anvil may be disposed partially within the void formed in the hammer. The first impact faces of the hammer and the anvil may be configured to be transverse during an impact between the first impact faces, and the second impact faces of the hammer and the anvil may be configured to be parallel during an impact between the second impact faces.

In some embodiments, the first impact face of the hammer may be configured to impact the first impact face of the anvil in response to rotation of the hammer in a first direction, and the second impact face of the hammer may be configured to impact the second impact face of the anvil in response to rotation of the hammer in a second direction opposite the first direction. The second impact face of the anvil may have a first end adjacent the cylindrical body and a second end adjacent an outer surface of the lug. The second impact face of the hammer may be configured to impact the first end during rotation of the hammer in the second direction. In some embodiments, the anvil may further include an output drive configured to mate with one of a plurality of interchangeable sockets. The first direction may be a counterclockwise direction, and the second direction may be a clockwise direction.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 1:
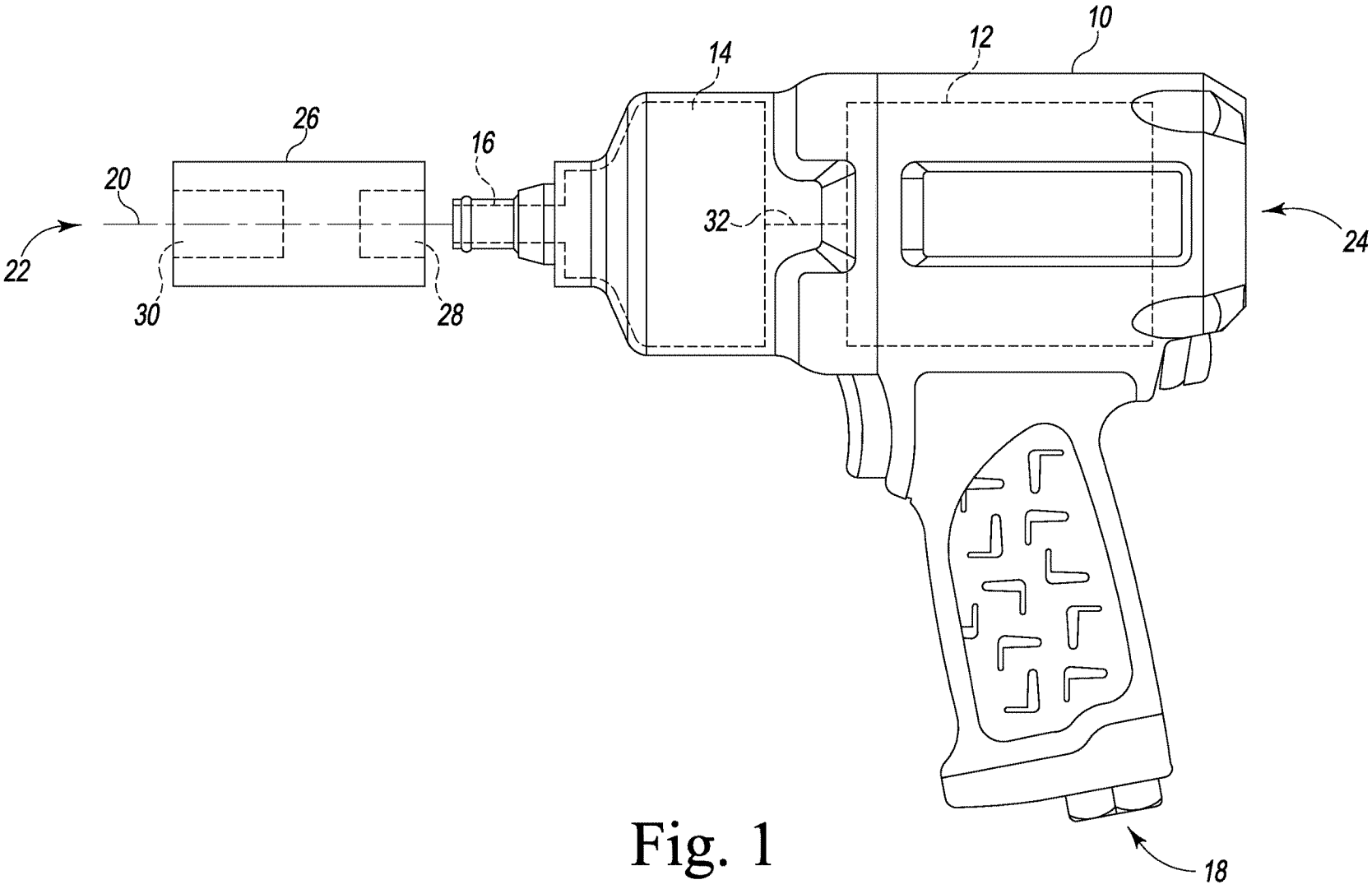
FIG. 1 is a side elevation view of one illustrative embodiment of an impact tool including a swinging weight impact mechanism, as well as a socket that may be used with the impact tool.

Referring now to FIG. 1, an impact tool 10 generally includes a motor 12 and an impact mechanism 14 configured to convert torque provided by the motor 12 into a series of powerful rotary blows directed from one or more hammers of the impact mechanism 14 to one or more anvils of the impact mechanism 14. That is, the motor 12 is configured to drive rotation of the impact mechanism 14 and thereby drive rotation of an output drive 16. As shown in FIG. 1, the motor 12 is illustratively embodied as a pneumatic motor coupled to a source of pressurized fluid (e.g., an air compressor) by an air inlet 18 of the impact tool 10. However, in other embodiments, the motor 12 may be embodied as any suitable prime mover including, for example, an electrically powered motor (i.e., an electric motor) coupled to a source of electricity (e.g., mains electricity or a battery).

The motor 12 and the impact mechanism 14 are adapted to rotate the output drive 16 in both clockwise and counterclockwise directions (e.g., for tightening and loosening fasteners) about an output axis 20. As illustratively shown in FIG. 1, the axis 20 may extend from a front output end 22 of the impact tool 10 to a rear end 24 of the impact tool 10. Depending on the particular embodiment, the motor 12 and/or one or more components of the impact mechanism 14 (e.g., the hammer, hammer frame, camming plate, gears, and/or other components described below) may be configured to rotate about the output axis 20, an axis parallel to the output axis 20, and/or an axis transverse to the output axis 20. For example, in some embodiments, the rotational axis of a rotor 32 of the motor 12 may be coincident with or parallel to the output axis 20. In other embodiments, the rotational axis of a rotor 32 of the motor 12 may be transverse (e.g., at a right angle) to the output axis 20. In other words, although the impact tool 10 is illustratively shown as a pistol-type impact tool 10, it is contemplated that the impact mechanisms of the present disclosure may be used in any suitable impact tool (e.g., an impact tool with a right-angle or other configuration).

As described in detail below, the impact mechanism 14 of the impact tool 10 is embodied as a "swinging weight" impact mechanism 14, in which one or more hammers 34 of the impact mechanism 14 each rotate about one axis (e.g., the axis 20 shown in FIG. 1) while also pivoting about another axis (different from the axis of rotation) to deliver periodic impact blows to an anvil 36 of the impact mechanism 14. In the various illustrative embodiments described herein, the swinging weight impact mechanism 14 may be similar, in certain respects, to one or more of a Maurer-type impact mechanism, a "rocking dog" type impact mechanism, and an "impact-jaw-trails-the-pivot-pin" type impact mechanism, illustrative embodiments of which are disclosed in U.S. Pat. Nos. 2,580,631; 3,661,217; 4,287,956; 5,906,244; 6,491,111; 6,889,778; and 8,020,630 (the entire disclosures of which are incorporated by reference herein). However, the presently disclosed swinging weight impact mechanisms 14 are configured to deliver more powerful rotary blows in one rotational direction (e.g., a loosening direction) than in the opposite rotational direction (e.g., a tightening direction).

In some embodiments, the anvil 36 of the impact mechanism 14 may be integrally formed with the output drive 16. In other embodiments, the anvil 36 and the output drive 16 may be formed separately and coupled to one another, such that the output drive 16 is configured to rotate as a result of rotation of the anvil 36. The output drive 16 is configured to mate with one of a plurality of interchangeable sockets 26

(e.g., for use in tightening and loosening fasteners, such as nuts and bolts). Although the output drive 16 is illustratively shown as a square drive 16, the principles of the present disclosure may be applied to an output drive 16 of any suitable size and shape. As shown in FIG. 1, the illustrative socket 26 includes an input recess 28, which is shaped to receive the output drive 16 of the impact tool 10, and an output recess 30, which is shaped to receive a head of a fastener.

In the illustrative embodiment, the impact mechanism 14 is directly driven by the motor 12. In particular, the rotor 32 of the motor 12 includes a plurality of vanes (not shown) that are configured to be driven by a supply of motive fluid. The rotor 32 is mechanically coupled to one or more components of the impact mechanism 14 (e.g., a camming plate or a hammer frame) via a splined interface 68 (see, for example, FIG. 2B). In other embodiments, the impact tool 10 may include a drive train operably coupled between the rotor 32 of the motor 12 and the impact mechanism 14. Depending on the particular embodiment, the drive train may include one or more gears (e.g., ring gears, planetary gear sets, spur gears, bevel gears, etc.) and/or other components configured to transfer torque from the motor 12 to the impact mechanism 14 and thereby drive rotation of the impact mechanism 14 and output drive 16.

Figure 2B:
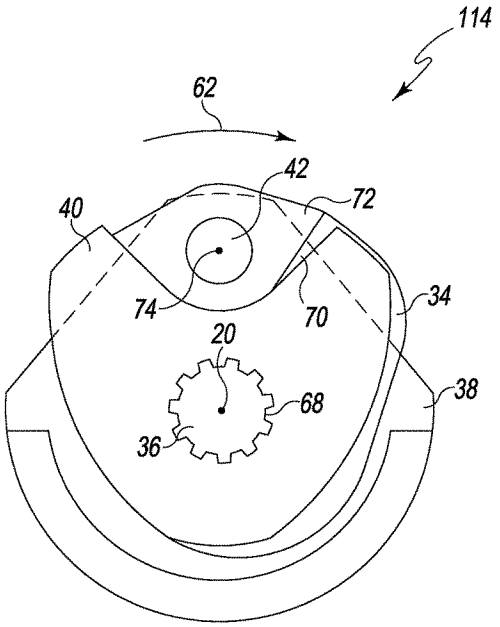
FIG. 2B is a rear-end cross-sectional view of the swinging weight impact mechanism of FIG. 2A.
Figure 2A:
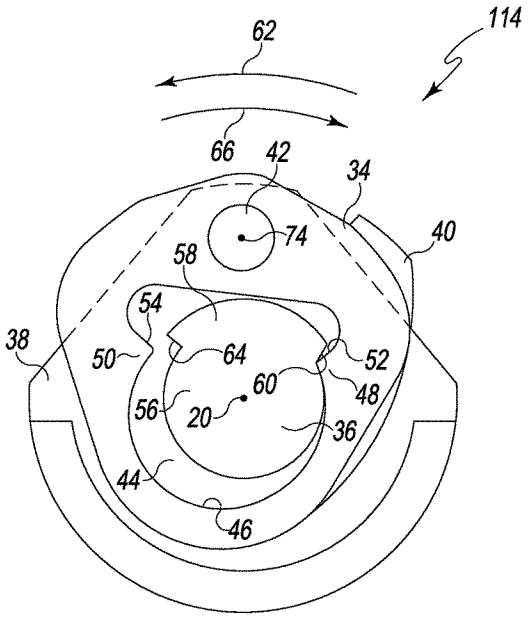
FIG. 2A is a front-end cross-sectional view of one illustrative embodiment of a swinging weight impact mechanism that may be used with the impact tool of FIG. 1.

Referring now to FIGS. 2A and 2B, one illustrative embodiment of a swinging weight impact mechanism 114 that may be used with the impact tool 10 is shown. In particular, FIG. 2A illustrates a cross-section of the impact mechanism 114 from the perspective of the front end 22 of the impact tool 10, while FIG. 2B illustrates a cross-section of the impact mechanism 114 from the perspective of the rear end 24 of the impact tool 10. The impact mechanism 114 illustratively includes a hammer 34, an anvil 36, a hammer frame 38, a camming plate 40, and a pivot pin 42. As can be seen in FIG. 2A, the anvil 36 extends along the axis 20 through an aperture defined in the hammer frame 38 and a void 44 formed in the hammer 34 (such that that the anvil 36 is disposed partially in the void 44). The void 44 is defined by an interior surface 46 of the hammer 34 and a pair of impact jaws 48, 50 that extend inward from the interior surface 46 (toward the axis 20), as shown in FIG. 2A. The impact jaw 48 of the hammer 34 includes a impact face 52, and the impact jaw 50 includes a impact face 54. Each of the impact faces 52, 54 is configured to impact a corresponding impact face 60, 64 of the anvil 36 (depending on the direction of rotation of the hammer 34), as described further below.

The hammer 34 is supported by the hammer frame 38 for rotation therewith about the axis 20. In particular, the hammer 34 is pivotably coupled to the hammer frame 38 via the pivot pin 42, which is disposed along an axis 74 that is generally parallel to and spaced apart from the axis 20. As will be appreciated from FIGS. 2A and 2B, the pivot pin 42 (and, hence, the axis 74) will rotate about the axis 20 when the hammer frame 38 rotates about the axis 20. Accordingly, the hammer 34 is configured to both pivot about the pivot pin 42 (i.e., about the axis 74) and to rotate about the axis 20. Of course, due to pivoting of the hammer 34 about the pivot pin 42, the center of the hammer 34 may follow a complex, non-circular path as the hammer 34 rotates about the axis 20.

The anvil 36 includes a cylindrical body 56 and a lug 58 that extends outward from the cylindrical body 56 (i.e., in a radial direction relative to the axis 20). The cylindrical body 56 of the anvil 36 is generally cylindrical in shape but may include sections of varying cross-section. As indicated above, the anvil 36 may be integrally formed with or coupled to the output drive 16 such that rotation of the anvil 36 drives rotation of the output drive 16. The lug 58 of the anvil 36 includes the impact face 60 that is impacted by the impact face 52 of the hammer 34 when the hammer 34 is rotated in a tightening direction 62 (e.g., clockwise from the perspective of the rear end 24 of the impact tool 10). The lug 58 of the anvil 36 also includes the impact face 64 that is impacted by the impact face 54 of the hammer 34 when the hammer 34 is rotated in a loosening direction 66 (e.g., counter-clockwise from the perspective of the rear end 24 of the impact tool 10). An outer surface 80 of the lug 58 extends between the impact faces 52, 54. The configuration of the anvil 36 is described in further detail below with reference to FIG. 3.

In the illustrative embodiment, the camming plate 40 is coupled to the rotor 32 of the motor 12 via a splined interface 68 between these components. As best seen in FIG. 2B, the camming plate 40 includes an aperture 70 defined therein within which a linkage 72 of the hammer 34 is disposed when the impact mechanism 114 is assembled. The camming plate 40 is configured to drive rotation of the hammer 34 (via the linkage 72) about the axis 20, when rotation of the camming plate 40 about the axis 20 is driven by the motor 12. The camming plate 40 also serves to bias the hammer 34 toward a disengaged position, in which the leading impact face 52, 54 (depending on the direction of rotation) of the hammer 34 does not impact the corresponding impact face 60, 64 of the lug 58 of the anvil 36. In other words, the camming plate 40 applies a force to the hammer 34 that includes a force component in a radially outward direction (e.g., away from the axis 20).

During operation of the impact tool 10, the motor 12 drives rotation of the camming plate 40 about the axis 20 such that the camming plate 40 drives rotation of the hammer 34 about the axis 20. That is, the camming plate 40 forces the linkage 72 of the hammer 34 in the same direction of rotation, thereby driving rotation of the hammer 34 itself and the pivotally coupled hammer frame 38 about the axis 20. As the hammer 34 rotates about the anvil 36, the lug 58 of the anvil 36 interacts with the interior surface 46 of the hammer 34 to move the hammer 34 into an engaged position (overcoming the radially outward biasing force applied by the camming plate 40). While in the engaged position, the hammer 34 continues to rotate about the anvil 36 until the leading impact face 52, 54 (depending on the direction of rotation) of the hammer 34 impacts the corresponding impact face 60, 64 of the lug 58 of the anvil 36 (as shown, for the rotational direction 62, in FIG. 2A).

Upon impact, the hammer 34 delivers a torque to the anvil 36 and rebounds from the anvil 36 in a direction opposite the direction of rotation of the hammer 34 prior to impact. By way of example, where the hammer 34 is traveling in the direction 62 prior to impact with the anvil 36, the hammer 34 will rebound in the direction 66 after impact (e.g., during the tightening of a fastener with the impact tool 10). As will be appreciated from the present disclosure, a greater torque may be transferred during an impact of the hammer 34 with the anvil 36 where the hammer 34 has full or direct contact, rather than partial or glancing contact, with the anvil 36. Glancing contact may occur, for example, if the impact face 52 of the hammer 34 and the impact face 60 of the anvil 36 are configured such that only portions of the impact faces 52, 60 contact one another during an impact (as shown in FIG. 2A), thereby dampening the amount of torque delivered from the hammer 34 to the anvil 36. In contrast, the impact face 54 of the hammer 34 and the impact face 64 of the anvil 36 are configured such that most or all of the impact faces 54, 64 will contact one another during an impact.

Upon impact of the hammer 34 and the anvil 36 during operation of the impact mechanism 114, a reactionary force is applied by the anvil 36 to the hammer 34 that causes the rebound of the hammer 34 described above (i.e., this reactionary force tends to separate the leading impact face 52, 54 of the hammer 34 from the corresponding impact face 60, 64 of the anvil 36). Due to the shape of the impact face 60 of the anvil 36 shown in FIG. 2A, when the hammer 34 is traveling in the direction 62 prior to impact, the reactionary force on the hammer 34 resulting from the impact includes a force component in a radially outward direction relative to the axis 20. In contrast, when the hammer 34 is traveling in the direction 66 prior to impact, the reactionary force on the hammer 34 resulting from the impact between the impact faces 54, 64 will generally not include a force component in a radially outward direction relative to the axis 20. Alternatively, the reactionary force on the hammer 34 resulting from the impact between the impact faces 54, 64 may have a force component in a radially outward direction relative to the axis 20 provided that the magnitude of this force component is less than that of the radially outward force component resulting from the impact between the impact faces 52, 60. In either case, after rebound, the camming plate 40 again biases the hammer 34 toward the disengaged position (such that the leading impact face 52, 54 of the hammer 34 is able to clear the corresponding impact face 60, 64 of the lug 58 of the anvil 36 and begin a new rotation around the anvil 36).

Figure 3:
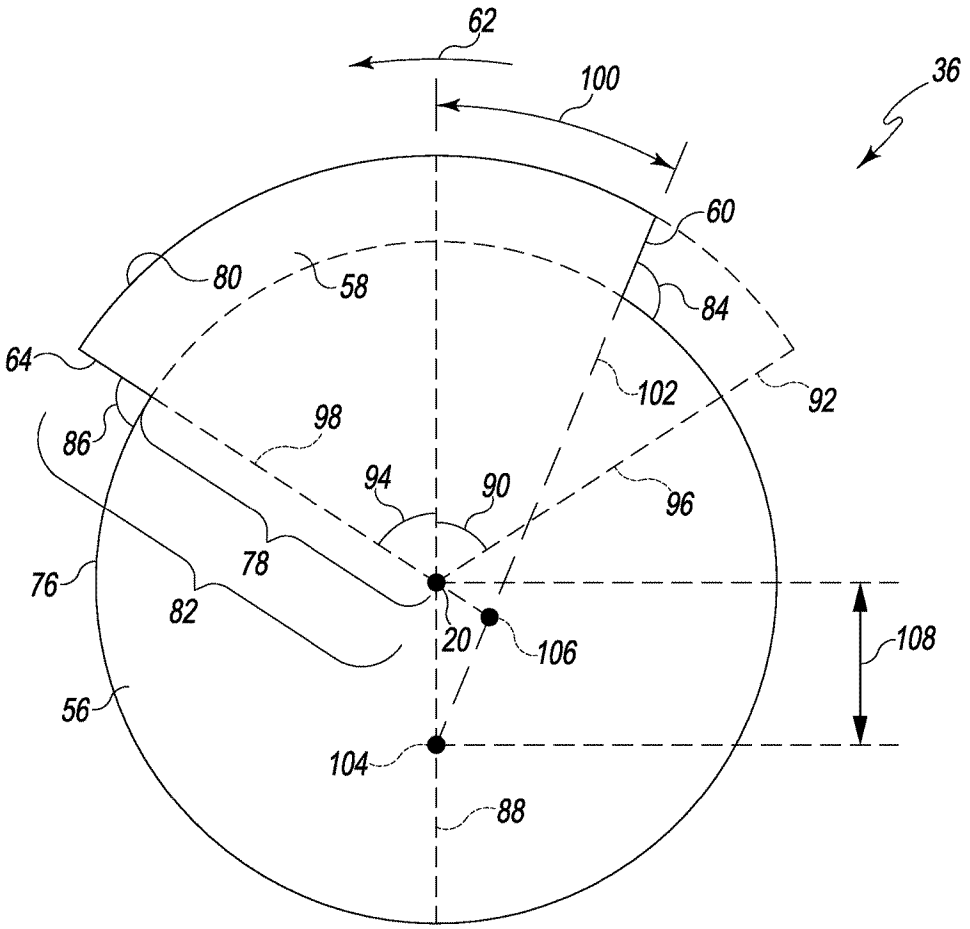
FIG. 3 is a front-end cross-sectional view of an anvil of the swinging weight impact mechanism of FIGS. 2A and 2B.

Referring now to FIG. 3, a detailed cross-section of the anvil 36 of FIG. 2A is shown. As described above, in the illustrative embodiment, the anvil 36 includes a cylindrical body 56 and a lug 58 extending outward from the cylindrical body 56 (in a radial direction relative to the axis 20). More specifically, an outer surface 76 of the cylindrical body 56 has a radius 78 relative to the axis 20, whereas the outer surface 80 of the lug 58 has a radius 82 relative to the axis 20 that is greater than the radius 78. Further, in the illustrative embodiment, the entire outer surface 76 of the cylindrical body 56 has the same radius 78, while the entire outer surface 80 of the lug 58 has the same radius 82. However, in other embodiments, the outer surfaces 76, 80 of the lug 58 and/or the cylindrical body 56 may have varying radii relative to the axis 20.

As can be seen in FIG. 3, the impact face 60 extends outward from the cylindrical body 56 at an angle 84 relative to the cylindrical body 56, and the impact face 64 extends outward from the cylindrical body 56 at an angle 86 relative to the cylindrical body 56. In the illustrative embodiment, the angle 84 is an obtuse angle, whereas the angle 86 is a right angle. In other words, the impact face 60 is orthogonal to the cylindrical body 56, whereas the impact face 64 is not.

In traditional impact mechanisms, the anvil 36 is typically symmetric about a midline 88 that is perpendicular to the axis 20 and passes through the lug 58, such that an angle 90 of a typical impact face 92 (shown in phantom) relative to the midline 88 is equal to an angle 94 of the impact face 64 relative to the midline 88. It should further be appreciated that, in a typical anvil 36 (as just described), a plane 96 coincident with the impact face 92 and a plane 98 coincident with the impact face 64 will oftentimes intersect one another at the axis 20. However, in the illustrative embodiment, the impact face 60 has been modified (relative to the typical impact face 92) such that the anvil 36 is asymmetric. In other words, according to the present disclosure, the anvil 36 is not symmetric about any line that is perpendicular to the axis 20 and passes through the lug 58.

Described in another way, the impact face 64 extends outward from cylindrical body 56 at an angle 94 relative to the midline 88 and coincides with a plane 98 that intersects the axis 20, whereas the impact face 60 extends outward from the cylindrical body 56 at an angle 100 relative to the midline 88 and coincides with a plane 102 that does not intersect the axis 20 (but does intersect the midline 88 at a different point 104). In the illustrative embodiment, the planes 98, 102 (along which the impact faces 64, 60 extend, respectively) intersect one another at a line 106 that passes through the cylindrical body 56 (the line 106 traveling into and out of the page in FIG. 3). It should be appreciated that there is an offset 108 between the axis 20 (e.g., the center of the cylindrical body 56), where the plane 98 intersects the midline 88, and the point 104 at which the plane 102 intersects the midline 88. It will be appreciated that an offset 108 along the midline 88 in a direction toward the lug 58 may reduce the tendency of the hammer 34 to disengage from the anvil 36 upon impact, whereas an offset 108 in a direction opposite the lug 58 (as shown in FIG. 3) may result in a greater disengaging moment arm. In the illustrative embodiment, the lug 58 extends outward from one half of the cylindrical body 56 (e.g., a top half, as shown in FIG. 3), while the line 106 at which the planes 98, 102 intersect passes through an opposite half of the cylindrical body 56 (e.g., a bottom half, as shown in FIG. 3).

Figure 4:
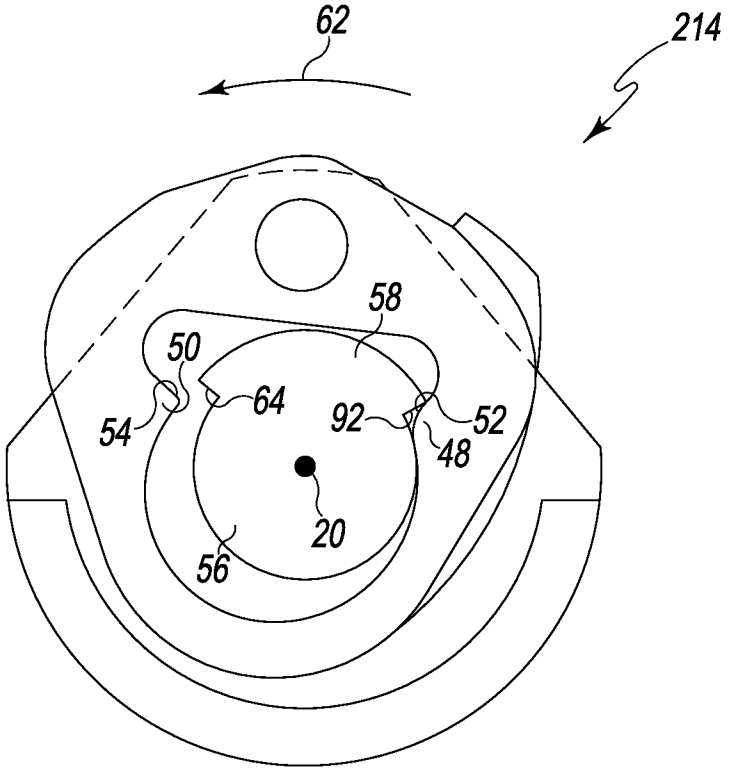
FIG. 4 is a front-end cross-sectional view of another illustrative embodiment of a swinging weight impact mechanism that may be used with the impact tool of FIG. 1.

Referring now to FIG. 4, another embodiment of a swinging weight impact mechanism 214 is shown in cross-section from the perspective of the front end 22 of the impact tool 10. Except as noted below, the description of the components and operation of the impact mechanism 114 of FIGS. 2A and 2B generally applies to the impact mechanism 214. In contrast to the asymmetric anvil 36 of the impact mechanism 114, the anvil 36 of the impact mechanism 214 has a traditional, symmetric configuration in which the impact faces 64, 92 of the lug 58 of the anvil 36 extend outwardly from the cylindrical body 56 of the anvil 36 at the same angle, as shown in FIG. 4. For example, in some embodiments, each of the impact faces 64, 92 may be orthogonal to the cylindrical body 56 of the anvil 36. However, in the impact mechanism 214, the impact face 52 of the impact jaw 48 of the hammer 34 has been angled or otherwise curved to reduce the amount of torque delivered by the hammer 34 to the anvil 36 when the hammer 34 is rotating in the direction 62 (i.e., when the impact face 52 of the hammer 34 impacts the impact face 92 of the anvil 36, as shown in FIG. 4). In other words, due to the shape of the impact face 52 of the hammer 34 shown in FIG. 4, when the hammer 34 is traveling in the direction 62 prior to impact, a reactionary force on the hammer 34 resulting from an impact will include a force component in a radially outward direction relative to the axis 20. Similar to the impact mechanism 114, however, an impact between the impact face 54 of the hammer 34 and the impact face 64 of the anvil 36 will generally result in greater torque being delivered to the anvil 36 (e.g., due to the impact faces 54, 64 being generally parallel upon impact).

Figure 5:
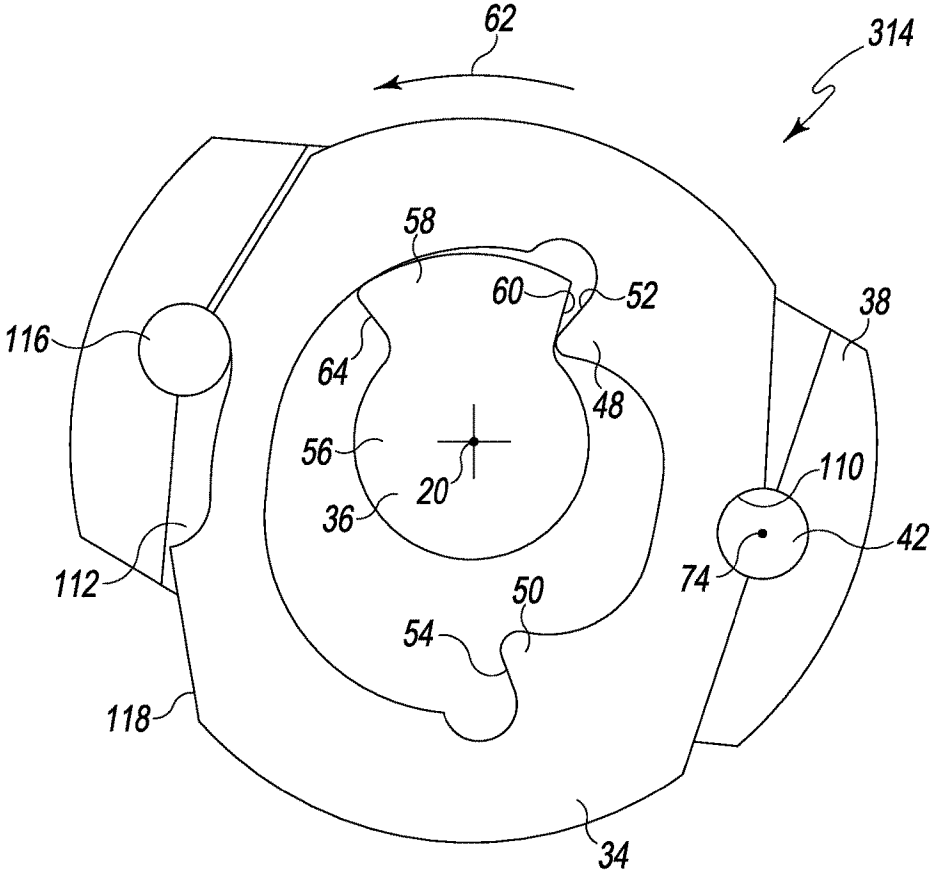
FIG. 5 is a front-end cross-sectional view of yet another illustrative embodiment of a swinging weight impact mechanism that may be used with the impact tool of FIG. 1.

Referring now to FIG. 5, yet another embodiment of a swinging weight impact mechanism 314 is illustrated in cross-section from the perspective of the front end 22 of the impact tool 10. The impact mechanism 314 is similar to a Maurer-type impact mechanism but incorporates the torque-limiting concepts of the present disclosure. In particular, the impact mechanism 314 includes an asymmetric anvil 36 that has a similar configuration to the asymmetric anvil 36 of the impact mechanism 114 described above.

Unlike the impact mechanism 114, the illustrative impact mechanism 314 does not include a camming plate. Rather, the hammer frame 38 is coupled directly (or, in some embodiments, via a drive train) to the rotor 32 of the motor 12. As such, rotation of the rotor 32 drives rotation of the hammer frame 38 about the axis 20, which in turn drives rotation of the hammer 34 about the axis 20. As shown in FIG. 5, a pivot groove 110 and a retaining groove 112 are each formed in an outer surface 118 of the hammer 34 on opposite sides of the hammer 34. In the illustrative embodiment, each of the pivot groove 110 and the retaining groove 112 extends substantially parallel to the axis 20. The pivot pin 42 is coupled to one side of the hammer frame 38 and is received in the pivot groove 110 of the hammer 34, while a retaining pin 116 is coupled to an opposite side of the hammer frame 38 and is received in the retaining groove 112. The retaining groove 112 and the retaining pin 116 are configured to limit a distance that the hammer 34 can pivot about the pivot pin 42.

During operation of the impact mechanism 314, the motor 12 drives rotation of the hammer frame 38, which is pivotally coupled to the hammer 34 by the pivot pin 42. Accordingly, the hammer frame 38 drives rotation of the hammer 34 in the same direction as the direction of rotation of the hammer frame 38. As the hammer 34 rotates about the anvil 36, the leading impact face 52, 54 (depending on the direction of rotation) of the hammer 34 will impact the corresponding impact face 60, 64 of the anvil 36, imparting a torque on the anvil 36 and causing the hammer 34 to rebound (in a manner generally similar to that described above with regard to the impact mechanism 114). As with the impact mechanism 114, the impact face 60 of the anvil 36 of the impact mechanism 314 extends outward from the cylindrical body 56 at a different angle than the impact face 64. As a result, less torque is transferred from the hammer 34 to the anvil 36 as a result of an impact between the impact faces 52, 60 (i.e., when the hammer is rotating in the direction 62) than as a result of an impact between the impact faces 54, 64 (i.e., when the hammer is rotating in the direction 66). Moreover, when the hammer 34 is traveling in the direction 62 prior to impact, a reactionary force on the hammer 34 resulting from an impact between the impact faces 52, 60 will include a force component in a radially outward direction relative to the axis 20 (whereas the reactionary force on the hammer 34 resulting from an impact between the impact faces 54, 64 will not include such a force component).

Figure 6B:
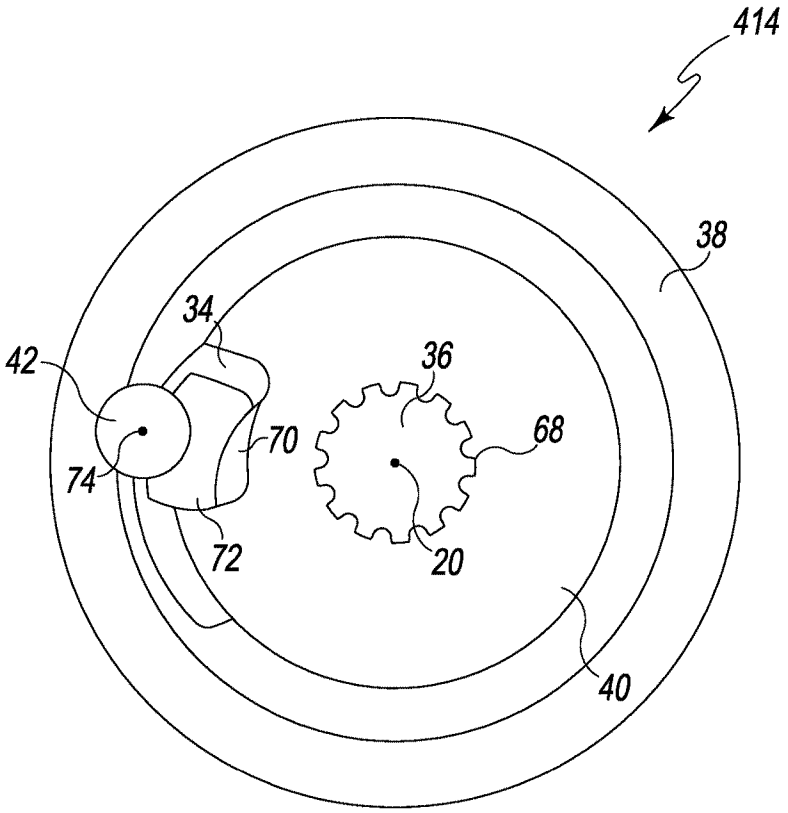
FIG. 6B is a rear-end cross-sectional view of the swinging weight impact mechanism of FIG. 6A.
Figure 6A:
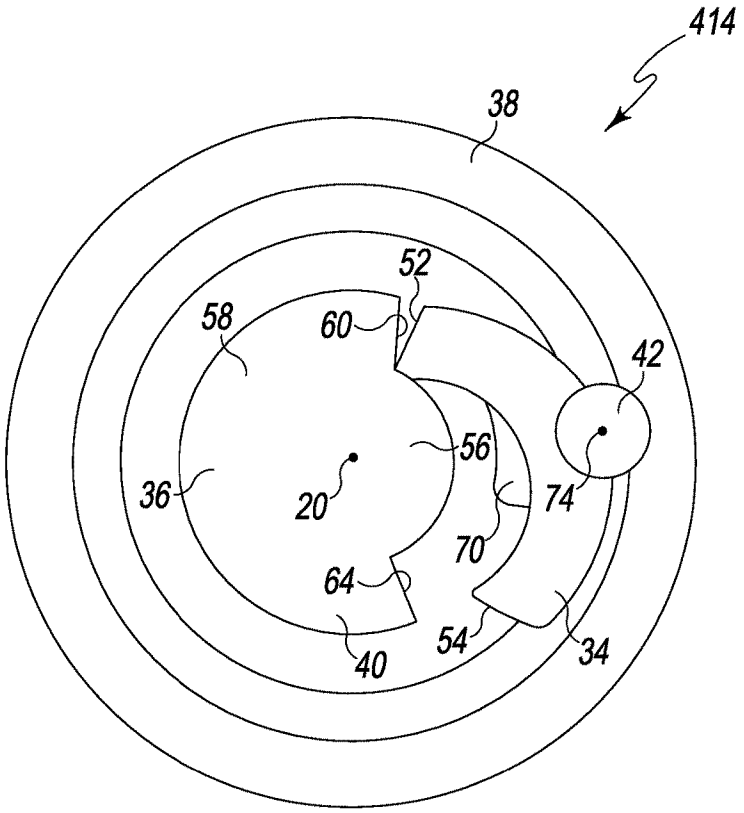
FIG. 6A is a front-end cross-sectional view of still another illustrative embodiment of a swinging weight impact mechanism that may be used with the impact tool of FIG. 1.

Referring now to FIGS. 6A and 6B, still another embodiment of a swinging weight impact mechanism 414 is shown. In particular, FIG. 6A illustrates a cross-section of the impact mechanism 414 from the perspective of the front end 22 of the impact tool 10, while FIG. 6B illustrates a cross-section of the impact mechanism 414 from the perspective of the rear end 24 of the impact tool 10. The impact mechanism 414 is similar to a "rocking dog" type impact mechanism but incorporates the torque-limiting concepts of the present disclosure. In particular, the impact mechanism 414 includes an asymmetric anvil 36. Although the components are sized and oriented differently, the impact mechanism 414 includes similar features to the impact mechanism 114 described above. For example, the impact mechanism 414 includes a hammer 34, an anvil 36, a hammer frame 38, a camming plate 40, and a pivot pin 42. Unlike the impact mechanism 114, however, the hammer 34 of the impact mechanism 414 is not formed with a void. Rather, as shown in FIG. 6A, the hammer 34 has a boomerang-shape that is pivotally coupled to the hammer frame 38 by the pivot pin 42. This differing configuration results in the hammer 34 of the impact mechanism 414 being in compression during an impact with the anvil 36 (which may be contrasted with the hammer 34 of the impact mechanism 114, which is in tension during an impact with the anvil 36). Similar to the impact mechanism 114, the hammer 34 includes an impact face 52 and an impact face 54.

Furthermore, the operation of the impact mechanism 414 is generally similar to that of the impact mechanism 114. For instance, during operation of an impact tool 10 incorporating the impact mechanism 414, the motor 12 drives rotation of the camming plate 40 via splined interface 68. The camming plate 40, in turn, drives rotation of the hammer 34 via the linkage 72. Upon impact with the anvil 36, the hammer 34 applies a torque to the anvil 36 and rebounds from the anvil 36 in the opposite direction. Additionally, as with the camming plate 40 of the impact mechanism 114, the camming plate 40 of the impact mechanism 414 biases the hammer 34 toward a disengaged position relative to the anvil 36 (e.g., radially outward relative to the axis 20).

As shown in FIG. 6A, the impact face 60 of the anvil 36 is angled relative to the cylindrical body 56 or otherwise shaped to receive a glancing impact from the impact face 52 of the hammer 34 (resulting in lower torque being transferred to the anvil 36), whereas the impact face 64 of the anvil 36 is shaped to be more directly impacted by the impact face 54 of the hammer 34 (resulting in greater torque being transferred to the anvil 36). Additionally, when the hammer 34 is traveling in the direction 62 prior to impact, a reactionary force on the hammer 34 resulting from an impact between the impact faces 52, 60 will include a force component in a radially outward direction relative to the axis 20 (whereas the reactionary force on the hammer 34 resulting from an impact between the impact faces 54, 64 will not include such a force component). It is also contemplated that, additionally or alternatively to modification of the impact face 60 of the anvil 36, the impact face 52 of the hammer 34 of the impact mechanism 414 may be modified to provide for a glancing impact between the impact faces 52, 60 (similar to the impact mechanism 214 shown in FIG. 4).

Figure 7:
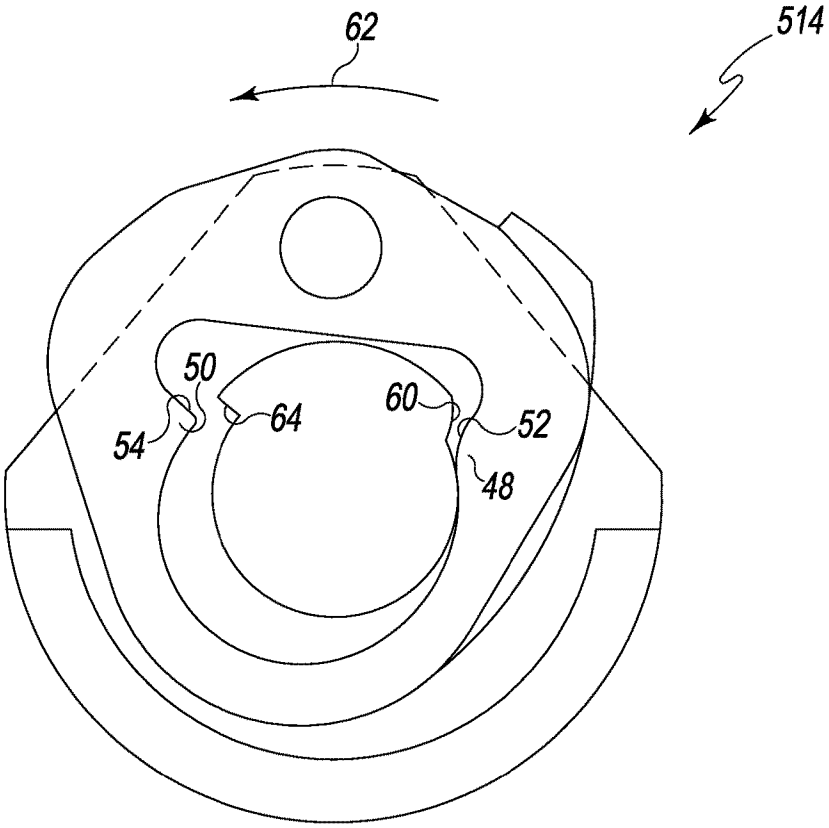
FIG. 7 is a front-end cross-sectional view of a further illustrative embodiment of a swinging weight impact mechanism that may be used with the impact tool of FIG. 1.

Referring now to FIG. 7, another alternative embodiment of a swinging weight impact mechanism 514 is shown from the perspective of the front end 22 of the impact tool 10. It will be appreciated that the impact mechanism 514 is similar in most respects to the impact mechanism 114 and, therefore, aside from the specific geometry of the impact faces 52, 60, the description of the components of the impact mechanism 114 equally applies to the corresponding components of the impact mechanism 514. As shown and described above with regard to FIG. 2A, the impact mechanism 114 includes a hammer 34 with generally planar impact faces 52, 54 and an anvil 36 with generally planar impact faces 60, 64.

However, in the illustrative embodiment of the impact mechanism 514 shown in FIG. 7, the impact face 60 of the anvil 36 and the impact face 52 of the hammer 34 have been curved (rather than angled) to reduce the amount of torque transferred from the hammer 34 to the anvil 36 upon impact, during rotation of the impact mechanism 514 in the direction 62. That is, during operation in the direction 62 (e.g., to tighten fasteners), the hammer 34 is configured to deliver a glancing blow to the anvil 36, whereas during operation in the opposite direction 66 (e.g., to loosen fasteners), the hammer 34 is configured to directly impact the anvil 36. It is contemplated that, in some embodiments, only one of the impact faces 52, 60 may be curved as shown in FIG. 7 (while the other of the impact faces 52, 60 remains a planar surface).

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. For example, while the impact mechanism 14 has been illustratively shown and described as including one hammer 34, it will be appreciated that the concepts of the present disclosure might also be applied to impact mechanisms including two or more hammers.

There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

a swinging weight impact mechanism comprising:

a hammer configured to rotate about a first axis and to pivot about a second axis different from the first axis, the hammer having a void formed therein; and an asymmetric anvil disposed partially within the void formed in the hammer, the asymmetric anvil being configured to rotate about a third axis when impacted by the hammer;

wherein the asymmetric anvil comprises a cylindrical body and a lug extending outward from the cylindrical body, the lug including (i) a first impact face that extends along a first plane, wherein the first plane contains the third axis and (ii) a second impact face that extends along a second plane, wherein the second plane does not intersect the third axis, the second plane intersecting the first plane along a line that passes through the cylindrical body of the asymmetric anvil.

2. The impact tool of claim 1, wherein the third axis is coincident with the first axis.

3. The impact tool of claim 1, wherein the asymmetric anvil is not symmetric about any line that is perpendicular to the third axis and passes through the lug.

4. The impact tool of claim 1, wherein:

the lug extends outward from a first half of the cylindrical body of the asymmetric anvil; and the line at which the first and second planes intersect passes through a second half of the cylindrical body of the asymmetric anvil that is opposite the first half.

5. The impact tool of claim 1, wherein:

the first impact face of the lug of the asymmetric anvil is configured to be impacted by the hammer in response to rotation of the hammer about the first axis in a first direction; and the second impact face of the lug of the asymmetric anvil is configured to be impacted by the hammer in response to rotation of the hammer about the first axis in a second direction opposite the first direction.

6. The impact tool of claim 5, wherein the asymmetric anvil further includes an output drive configured to mate with one of a plurality of interchangeable sockets.

7. The impact tool of claim 1, wherein the swinging weight impact mechanism further comprises a hammer frame supporting the hammer for rotation therewith about the first axis, the hammer being pivotably coupled to the hammer frame via a pivot pin disposed along the second axis.

8. The impact tool of claim 7, further comprising a motor coupled to the hammer frame and configured to drive rotation of the hammer frame about the first axis.

9. The impact tool of claim 7, further comprising a motor coupled to a camming plate of the swinging weight impact mechanism, the motor being configured to drive rotation of the camming plate about the first axis such that the camming plate drives rotation of the hammer about the first axis.

10. An impact tool comprising:

a swinging weight impact mechanism comprising:

a hammer frame supporting a hammer for rotation therewith about a first axis, the hammer being pivotably coupled to the hammer frame such that the hammer is configured to pivot about a second axis different from the first axis;

a camming plate configured to rotate about the first axis to drive rotation of the hammer about the first axis; and an asymmetric anvil configured to rotate about the first axis when impacted by the hammer, the asymmetric anvil comprising a cylindrical body and a lug extending outward from the cylindrical body, the lug including (i) a first impact face extending outward from the cylindrical body at a first angle relative to the cylindrical body and (ii) a second impact face extending outward from the cylindrical body at a second angle relative to the cylindrical body, the second angle being different from the first angle.

11. The impact tool of claim 10, wherein the cylindrical body has a first radius relative to the first axis and the lug has a second radius relative to the first axis, the second radius being greater than the first radius.

12. The impact tool of claim 11, wherein the lug includes an outer surface extending between the first and second impact faces, an entirety of the outer surface having the second radius.

13. The impact tool of claim 10, wherein:

the first impact face extends along a first plane that is orthogonal to the cylindrical body; and the second impact face extends along a second plane that is not orthogonal to the cylindrical body.

14. The impact tool of claim 10, wherein the asymmetric anvil is not symmetric about any line that is perpendicular to the first axis and passes through the lug.

15. An impact tool comprising:

a swinging weight impact mechanism comprising:

a hammer configured to rotate about a first axis and to pivot about a second axis different from the first axis, the hammer including a first impact face and a second impact face;

a camming plate configured to rotate about the first axis to drive rotation of the hammer about the first axis; and an anvil configured to rotate about the first axis when impacted by the hammer, the anvil including a cylindrical body and a lug extending outward from the cylindrical body, the lug including a first impact face and a second impact face;

wherein the first impact faces of the hammer and the anvil are arranged such that a reactionary force resulting from an impact between the first impact faces includes a first force component in a radially outward direction relative to the first axis; and wherein the second impact faces of the hammer and the anvil are arranged such that a reactionary force resulting from an impact between the second impact faces does not include a second force component in a radially outward direction relative to the first axis that is equal in magnitude to or greater in magnitude than the first force component.

16. The impact tool of claim 15, wherein:

the hammer is formed to include a void and first and second jaws extending into the void, the first jaw including the first impact face of the hammer and the second jaw including the second impact face of the hammer; and the anvil is disposed partially within the void formed in the hammer.

17. The impact tool of claim 15, wherein:

the first impact faces of the hammer and the anvil are configured to be transverse during an impact between the first impact faces; and the second impact faces of the hammer and the anvil are configured to be parallel during an impact between the second impact faces.

18. The impact tool of claim 15, wherein:

the first impact face of the hammer is configured to impact the first impact face of the anvil in response to rotation of the hammer in a first direction; and the second impact face of the hammer is configured to impact the second impact face of the anvil in response to rotation of the hammer in a second direction opposite the first direction.

19. The impact tool of claim 18, wherein the second impact face of the anvil has a first end adjacent the cylindrical body and a second end adjacent an outer surface of the lug, the second impact face of the hammer being configured to impact the first end during rotation of the hammer in the second direction.

20. The impact tool of claim 18, wherein the anvil further includes an output drive configured to mate with one of a plurality of interchangeable sockets.

* * * * *